United States Patent [19]

Noréus et al.

[11] Patent Number: 4,592,804

[45] Date of Patent: Jun. 3, 1986

[54] METHOD FOR PRE-TREATING LIGNOCELLULOSIC MATERIAL IN TWO STEAMING ZONES

[75] Inventors: Sture Noréus; Hans Lundberg; Lars Uhlin; Bengt Lindquist, all of Husum, Sweden

[73] Assignee: Mo och Domsjo AB, Ornskoldsvik, Sweden

[21] Appl. No.: 622,944

[22] Filed: Jun. 21, 1984

[30] Foreign Application Priority Data

Jun. 27, 1983 [SE] Sweden ..... 8303646-7

[51] Int. Cl.[4] ..... D21C 1/02

[52] U.S. Cl. ..... 162/19; 162/68

[58] Field of Search ..... 162/19, 47, 68, 242, 162/246, 52, 251, 63

[56] References Cited

U.S. PATENT DOCUMENTS 3,619,348 11/1971 Asplund et al. ..... 162/19
3,711,367 1/1973 Christenson ..... 162/251
4,061,193 12/1977 Laakso et al. ..... 162/251
4,135,966 1/1979 Glöersen ..... 162/251
4,401,510 8/1983 Olson et al. ..... 162/68

*Primary Examiner*—Steve Alvo

[57] ABSTRACT

In the continuous manufacture of cellulose pulp it has been found that air often remains in the lignocellulosic material subsequent to steaming the same. These air inclusions cause the lignocellulosic material to float in the cooking liquid, which results in interruptions in the digestion process. This problem is solved by means of the present invention, which relates to a method in which prior to being steamed, the lignocellulosic material is brought into contact with a heating medium. The method is characterized by supplying the heating medium to the advancing lignocellulosic material at several occasions; by distributing the heating medium in a manner such as to increase the temperature of the material in the direction in which it is advanced; and by separating condensed liquid from the lignocellulosic material.

The invention also relates to apparatus for carrying out the above method.

4 Claims, 1 Drawing Figure

METHOD FOR PRE-TREATING LIGNOCELLULOSIC MATERIAL IN TWO STEAMING ZONES

TECHNICAL FIELD

The present invention relates to a method and apparatus for pre-treating lignocellulosic material in the continuous digestion of lignocellulosic material to cellulose pulp. The invention is suitable for application with all digestion methods. Examples of such methods include the sulphate method, the sulphite method and various semi-chemical methods. The method can also be applied suitably with all kinds of lignocellulosic material, although it is particularly suitable for application when the lignocellulosic material to be treated is in the form of wood chips.

BACKGROUND ART

In order to obtain a good end-product, i.e. good cellulose pulp, when digesting lignocellulosic material, it is necessary to steam the chips well, prior to adding cooking chemicals thereto. In the continuous digestion of wood chips, it is normal practice to pass the chips through a steaming vessel to which steam is introduced, this steam comprising mainly withdrawn steam, i.e. steam which has been generated in and recovered from somewhere in the pulp manufacturing process. This steam is often fortified with fresh low-pressure steam, particularly during the winter time.

In the winter time, when the chips introduced into the steamer are often frozen, it is difficult to obtain complete penetration of the steam into and through all the chip portions. Steaming can also be unsuccessful to varying degrees in other parts of the year. This can result in serious difficulties when digesting wood to cellulose pulp. Incomplete steaming of the chips means that air remains therein. The air may remain in such quantities as to render the chips buoyant, so that they float in the cooking liquor. It has been found, that the chip column may cease to move down through the continuous digester altogether.

In recent years, it has therefore become more and more usual to pre-heat the chips, so as to facilitate and improve the steaming process. One method of pre-heating the chips is to feed them to a cylindrical vessel and to apply heat to the periphery thereof with the aid of a heating medium, normally steam of some kind. It has been found difficult to heat the whole of the chip flow. In particular, those chips located in the centre of the vessel are not always heated satisfactorily. If the flow of steam is increased in order also to heat the chips located in the centre of the vessel to a sufficient extent, steam will often penetrate through the chip column. Problems then occur in the apparatus located upstream of the pre-heating stage, for example chip screws or belt conveyors. Another disadvantage with pre-heating methods of the aforedescribed kind is that the condensate formed accompanies the chips and dilutes the cooking liquor. Furthermore turpentine is lost with this condensate.

DISCLOSURE OF THE INVENTION

TECHNICAL PROBLEM

Previous known methods for pre-heating lignocellulosic materials have been found unsatisfactory as regards pre-treating the lignocellulosic material (chips) in such a manner that the subsequent steaming results in a material which, when coming into contact with the cooking liquor, is free of air.

SOLUTION

The aforesaid problems are solved by means of the present invention, which relates to a method for pre-treating lignocellulosic material in the continuous digestion of lignocellulosic material to cellulose pulp, in which the material is brought into contact with a heating medium, prior to being steamed, characterized by supplying the heating medium during the substantially horizontal advance of said lignocellulosic material at several occasions; and by so distributing the heating medium that the temperature of said material increases in the direction of chip advancement; and by separating condensed liquid from the lignocellulosic material.

One example of such a heating medium is steam, this medium being that preferred in accordance with the invention.

In accordance with the invention the lignocellulosic material is preferably advanced along at least two, mutually sequential and sinking planes. Preferably the heating medium is fed solely to the first horizontal plane, in the direction in which the lignocellulosic material advances.

The supply of steam causes condensation, and this condensate is separated from the lignocellulosic material before it is passed to the next treatment stage. The condensate liquid is allowed to run off the lignocellulosic material and is collected, preferably at the terminal end of the first horizontal plane and/or at the beginning of the second horizontal plane. In order to assist the condensate in running from the material, the material can be caused to pass through one or more zones in which subpressures prevail.

The invention also relates to apparatus for pre-heating lignocellulosic material in the continuous digestion of lignocellulosic material to cellulose pulp, said apparatus comprising a vessel having a lignocellulosic-material outfeed end which is connected, either indirectly or directly, to a steaming tank, characterized in that the vessel is provided at least at its lignocellulosic-material infeed end, and principally at its substantially horizontal bottom, with a plurality of heating-medium supply pipes; and in that said vessel is provided with at least one means for separating condensate from the lignocellulosic material.

The vessel terminates in a vertical channel which merges with a horizontal channel located therebeneath. The vessel may comprise further stages including a vertical channel and a horizontal channel located on a lower plane.

The vessel may have any cross-sectional shape, although a rectangular cross-section is preferred.

The apparatus according to the invention may be connected to or combined with a chip-storage vessel, a so-called chip silo, at the infeed end of said apparatus. The outfeed end of the apparatus is suitably connected to a conventional infeed system for feeding chips to a continuous digester.

The means for separating condensate from the lignocellulosic material may advantageously comprise a suction box with associated lines.

ADVANTAGES

The invention enables steaming to be effected in the manner intended, i.e. so that the chips are completely free of air when impregnated with cooking liquor. This eliminates the risk of chips floating in the cooking liquor in a manner to create problems in the running of the continuous digester. As a result of that it becomes possible to manufacture a pulp with a rather uniform lignin content and with a high strength.

The invention also enables the separated turpentine-containing condensate to be utilized.

DESCRIPTION OF A PREFERRED EMBODIMENT

Figure 1:
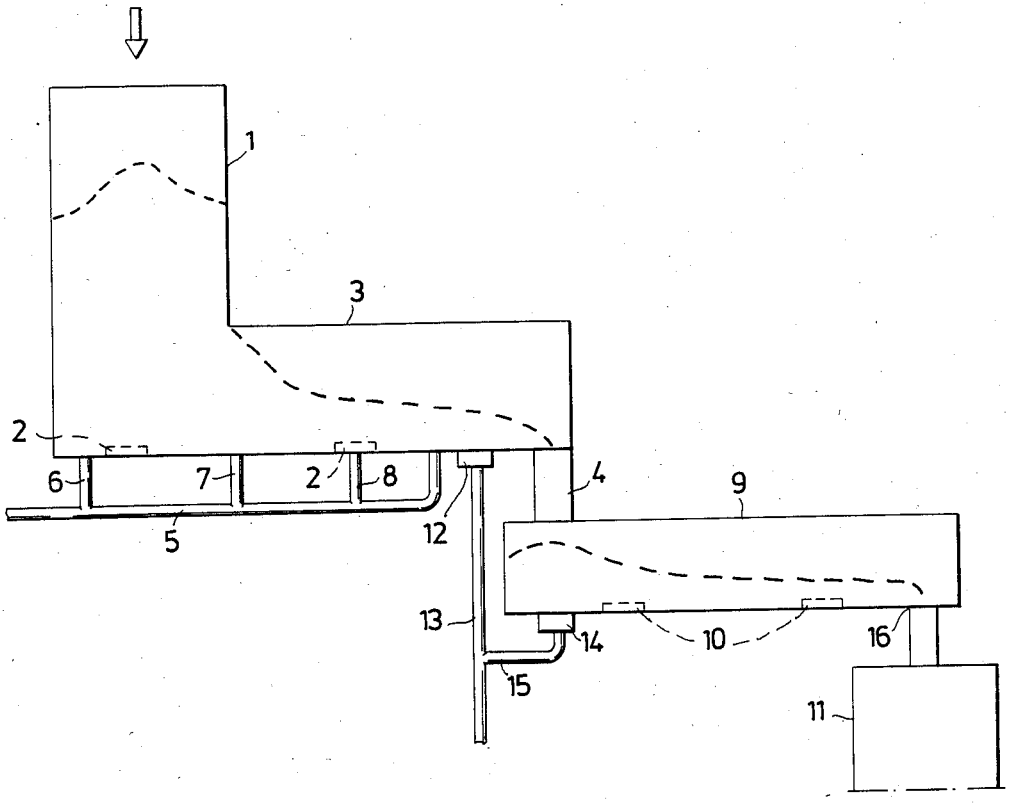
FIG. 1 illustrates apparatus according to the invention.

FIG. 1 illustrates schematically a method of applying the invention.

Wood in the form of chips is conveyed to a chip silo 1. The silo may have any desired cross-sectional shape whatsoever, although it is preferably of rectangular cross-section, similar to that illustrated in the drawing. The chips fall down into the silo 1 and form therein a chip column (the top of which is shown in by a broken line.). The chips are advanced along a horisontal rectangular channel 3 to a vertical channel 4, with the aid of a stoker means 2. Steam is passed to the bottom of the silo 1 and the channel 3, so as to penetrate and heat the wood chips located therein. The steam is supplied through a line 5 having branch pipes 6, 7 and 8 extending therefrom. The steam is introduced laterally into the bottom of the silo 1 and the channel 3 at a number of locations (not shown in the drawing). By spreading the supply of steam in this manner, the temperature of the chips is increased in the direction in which they are advanced. The chips fall down through the channel 4, into a second rectangular, horizontal channel 9. This channel is also provided with a stoker means, referenced 10 in the Figure, which advances the chips along the channel to a fall chute 16. The chute is connected to a conventional chip infeed system 11 comprising, for example, a chip hopper and chip wheel connected to the steaming vessel (not shown in the drawing).

At the terminal end of the bottom of channel 3, the chips are passed over a suction box 12, which collects the condensate running down from the chips and passes said condensate through a pipe 13. A further suction box 14 is arranged at the beginning of the bottom of channel 9. The major part of the condensate remaining in the flow of chips runs from the chips, down into the box 14 and is lead away through pipe 15, which is connected to the pipe 13.

The steam supplied through the line 5 may comprise steam withdrawn from any stage of the pulp manufacturing process, or may comprise fresh steam. The locations at which the steam is supplied to the chips are distributed along the bottom of the silo 1 and the channel 3 in a manner to ensure that the advancing chips are heated most uniformly. Although in the illustrated embodiment steam is only supplied through the bottom of the silo 1 and the channel 3, it will be understood that steam may also be supplied through the sides of said silo and channel. Steam may also be supplied at the infeed end of the channel 9. The supply of steam, however, should be terminated before the chip flow passes the last suction box.

The stoker means 2 and 10 illustrated in the drawing can be replaced with other chip feeders, such as a plurality of parallel screws. It will also be understood that the condensate draining devices, such as the suction boxes shown by way of example in the drawing, may be more than two in number.

We claim:

1. A process for preheating particulate lignocellulosic material to prepare it for steaming followed by continuous chemical digestion by pulping liquor to form cellulose pulp, so as to ensure that the steamed lignocellulosic material is substantially free from air when brought into contact with the pulping liquor, which comprises:

(1) advancing a mass of particulate lignocellulosic material along a substantially horizontal plane through a first steaming zone;

(2) feeding steam from a plurality of substantially uniformly spaced locations into the mass within the first steaming zone in a manner to heat the lignocellulosic material uniformly throughout the mass;

(3) feeding the steam into the mass under such conditions that steam condenses on the material, and steam condensate descends by gravity through the mass to the bottom of the first steaming zone;

(4) collecting and removing from the bottom of the zone the steam condensate running off the particulate lignocellulosic material; and then (5) while advancing the mass of particulate lignocellulosic material along a substantially horizontal plane through a second steaming zone steaming the material until the lignocellulosic material is substantially free from air.

2. A process according to claim 1 in which the first steaming zone is arranged along a substantially horizontal but descending plane.

3. A process according to claim 2 in which the first steaming zone is separated into two descending planes.

4. A process according to claim 1 which comprises removing steam condensate from the bottom of the first steaming zone by suction.

* * * * *